United States Patent [19]

Hartkopf et al.

[11] 4,143,534

[45] Mar. 13, 1979

[54] WORKPIECE FEED CHANNEL

[75] Inventors: Heinz Hartkopf, Solingen; Horst Schneider, Witzhelden, both of Fed. Rep. of Germany

[73] Assignee: Th. Kieserling & Albrecht, Solingen, Fed. Rep. of Germany

[21] Appl. No.: 826,205

[22] Filed: Aug. 19, 1977

[51] Int. Cl.[2] ..... B21D 3/04

[52] U.S. Cl. ..... 72/98; 72/99; 414/478

[58] Field of Search ..... 72/98, 99, 100, 222, 72/250, 252, 257, 428; 82/38 R; 214/1 P, 1 PB

[56] References Cited

U.S. PATENT DOCUMENTS

| | | | |
|---|---|---|---|
| 2,820,573 | 1/1958 | McConnell | 214/1 PB |
| 3,118,546 | 1/1964 | McConnell et al. | 214/1 PB |
| 3,759,077 | 9/1973 | Hartkopf | 72/99 |
| 4,038,861 | 8/1977 | Hartkopf et al. | 82/38 R |

*Primary Examiner*—Lowell A. Larson
*Attorney, Agent, or Firm*—Edward E. Sachs

[57] ABSTRACT

A feed channel for elongated workpieces including a plurality of adjustable workpiece receiving openings. Each opening is formed by a plurality of profiled segments including a fixed segment and at least one movable segment. The movable segments are movable to expose the openings for lateral introduction thereinto of an elongated workpiece. The movable segments are then moved to reduce the size of the openings and engage the workpiece for at least partially straightening same. The movable segments are then moved to increase the size of the openings for providing longitudinal and rotational movement of the workpiece relative to the openings. Workpieces are smoothly carried into the feed channel instead of being rolled or dropped thereinto. The fixed segments are positioned and profiled for locating the longitudinal axes of various diameter workpieces in the same plane.

5 Claims, 7 Drawing Figures

FIG. 3
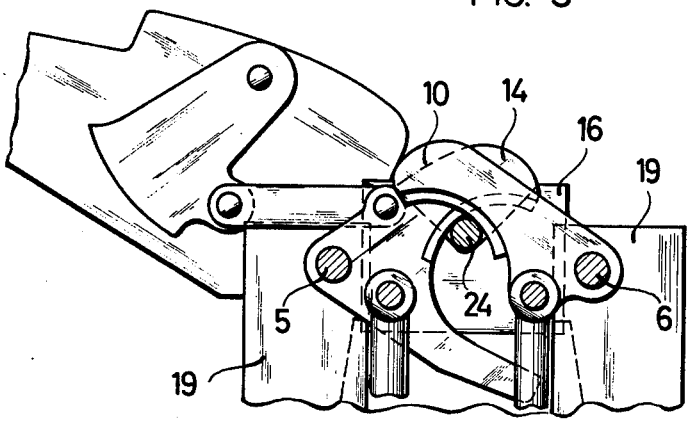
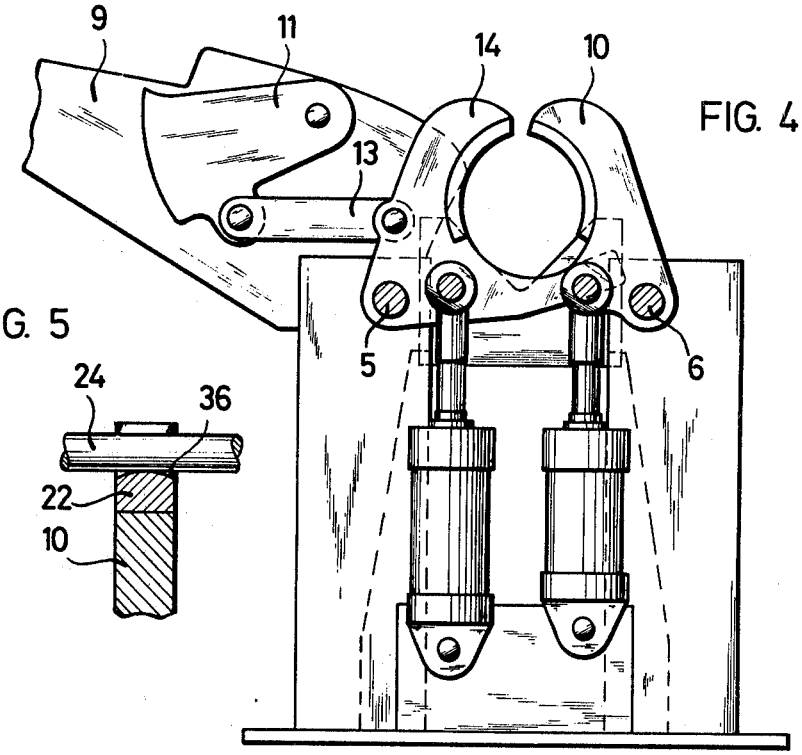
FIG. 4
FIG. 5

WORKPIECE FEED CHANNEL

The invention relates generally to workpiece feed channels and, more particularly, to enclosed feed channels for feeding elongated rigid workpieces. The feed channel is particularly applicable for feeding elongated workpieces having a generally circular cross-sectional shape, such as wire, rod and pipe. The feed channel is particularly useful for feeding such workpieces in combination with peeling and straightening machines, and the workpieces rotate rapidly as they move longitudinally through the channel.

In modern straightening machines having two or more rolls, the end of the workpiece being straightened undergoes helical movements. The rotary component of these helical movements causes the ends of the workpiece held in the inlet and outlet channels of the straightening machine to carry out heavy flailing movements. The resulting noise and wear, both in the workpiece being worked upon or straightened, and in the inlet and outlet channels, restricts the output of straightening machines. This is particularly inconvenient when straightening and peeling machines are arranged one after the other because the output of the peeling machine cannot be greater than that of the straightening machine. The inadequacies of existing feed channels become apparent as soon as the workpiece drops into them. For instance, when a heavy workpiece drops into the channel, it produces an unpleasantly loud noise. The larger the cross section of the channel, the farther the workpiece falls, and the louder the noise. From this point of view, it would be better to have a channel with a small cross section. However, it is also possible for the workpiece to be so curved longitudinally that all of it cannot drop into the channel, and from this point of view it would therefore be better to have a channel of larger cross section. Again, from the point of view of feeding the workpiece through the channel, it would be better to have a channel with a small cross section, thus minimizing the flailing of the workpiece therein and the above mentioned disadvantages associated therewith, i.e., restriction of output, noise and increased wear. For high output, it would be better to have a channel adapted to the diameter of the workpiece.

In addition to the disadvantages mentioned above, namely that small workpieces in large channels carry out violent flailing movements, there is the problem that, in a channel designed for a specific range of diameters of products to be straightened, smaller workpieces, which have more room in the channel, also rotate faster than larger workpieces. The reason for this is that the straightening rolls in a two-roll straightener impart a specific peripheral velocity to the workpiece and this inevitably causes small diameter workpieces to rotate faster than those of larger diameter. For economic reasons, channels of the type outlined above are usually designed for a particular range of diameters, in order to avoid frequent channel changes.

Channels are known which are divided into two or more segments in profile, one or more of which is pivotable or displaceable, so that the channel may be opened for the purpose of picking up and putting down the workpiece to be transported.

It is therefore a primary object of the invention to provide a workpiece feed channel of the type outlined above which will be suitable for transporting workpieces of a large range of diameters.

It is a further object of the invention to provide such a feed channel which makes high speed straightening possible.

It is another object of the invention to provide such a feed channel which improves the quality of the straightening process.

It is an additional object of the invention to provide such a feed channel which at least partially straightens longitudinally curved elongated workpieces when they are introduced into the channel.

It is also an object of the invention to provide such a channel having adjustable workpiece receiving openings.

An aspect of the invention resides in a feed channel having a plurality of diaphragm-like adjustable openings arranged consecutively therealong. Each opening is formed by a plurality of profiled segments including at least one movable segment. The largest diameter of such a channel may therefore be designed according to the curvatures of the workpieces. When the movable profiled segments are pivoted in one direction the size of the openings is enlarged, and when the movable segments are pivoted in the opposite direction, the size of the openings is reduced. Since the channel can alter the diameter of the openings through it somewhat like a diaphragm in a camera by moving the movable segments, workpieces of small diameter may also be processed at high feed velocities and high rotational velocities. Furthermore, workpieces having a considerable degree of curvature may be pre-straightened while they are still stationary. This is achieved by moving the movable channel segments to initially reduce the channel or opening cross section by an amount greater than that required to feed the workpiece, after which the segments are moved back to provide the correct cross section to feed the workpiece. This pre-straightening not only reduces the friction arising when the rotating workpiece is passing through the channel, but also improves the straightening action of the machine itself.

In order to be able to reduce the cross section of the channel to less than the cross section of the workpiece, provision is made for profiled arcs to be arranged at longitudinally-spaced intervals along the length of the channel. This makes it possible to bend the workpiece beyond its ideal shape. The spacing of the arcs is governed by the diameter of the smallest workpiece to be transported in the channel.

The surfaces of the profiled segments facing the workpiece are lined with segmental arcs made of a different material, for example a synthetic material such as plastic or the like. In order to prevent the workpiece from being marked by the segments during straightening in the channel, provision is made, according to another characteristic of the invention, for the surfaces of the segments facing the workpiece to be rounded off cross-sectionally to match the general shape of the workpiece. The shape of the profiled segments may be other than that of an arc. A kink or generally V-shaped surface approximately in the middle of the segment could increase the number of sides and angles of the polygonal shape of the openings, making the angles between adjacent sides more obtuse.

In order to eliminate the blow of the workpiece falling into the channel a catcher projection extending outside the profile of the channel or openings when the latter are closed is formed integrally with the ends of the movable profiled segments facing the feed grid. The said projections blend into the arcs of the profiled segment sections facing the workpiece. The catcher projection is a constituent part of a device for lifting in the workpieces. When the channel is open, the workpiece rolls toward the said catcher projection, and slides or rolls slowly between it and a rounded incline on the feed grid into the lower profiled segment. This design is particularly recommended for the invention because the length of the catcher projection is not limited by the opposing profiled segments in view of the fact that only one profiled segment section is provided in any given length of the channel.

According to a simplified configuration of the invention, one profiled segment may be secured immovably to the channel stand. In this case, the diaphragm-like adjustable opening function is still retained even if the laminated profiled segment sections of a profiled segment are immovable. This immovable arrangement of the lower profiled segment also has the advantage that the bottom surfaces of workpieces of different diameters are held at the same height in the straightening machine.

Instead of rolling or dropping the workpieces into the channel, carrier means is provided for smoothly and positively carrying the workpieces into position against the fixed segment. The fixed segment is positioned and profiled for locating the longitudinal axes of various diameter workpieces in a common plane extending in the same direction as the opposed direction of straightening rolls through which the workpieces pass.

For a better understanding of the present invention, together with other and further objects thereof, reference is had to the following description taken in connection with the accompanying drawings, and its scope will be pointed out in the appended claims.

In the drawing:

FIG. 3 is a partial view similar to FIG. 2 and showing the channel in the process of pre-straightening a workpiece;

FIG. 4 is a cross-sectional elevational view taken generally on line IV—IV of FIG. 1 and showing the channel at its largest possible diameter for transporting large diameter workpieces;

FIG. 5 is a cross-sectional elevational view of a profiled segment;

Figure 1:
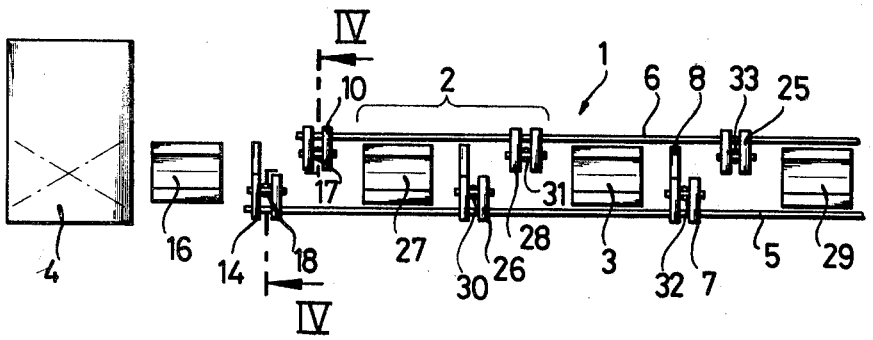
FIG. 1 is a plan view of a feed channel according to the invention, the channel to be used as an inlet feed channel on a two-roll straightening machine.

FIG. 1 shows channel 1 having a plurality of individual laminated profiled segment sections 3, 7, 10, 14, 16, 25, 26, 27, 28 and 29 shown in separated or paired arrangement, as preferred for straightening and guiding large diameter workpieces. A two-roll straightening machine 4 is attached to the channel 1, and moves elongated workpieces rotatably and longitudinally relative to the channel 1. A separated profiled segment section is regarded as a unit. Three profiled segment sections, for example segments 26, 27 and 28, constitute an adjustable opening 2. Profiled segment sections 7, 14 and 26 facing input grid 9 of FIG. 2 each has a catcher projection 8 as shown for the segment 14 in FIG. 2. Profiled segment sections arranged at the same angular position in relation to the workpiece, such as segments 10, 25 and 28, or 16, 27, 3 and 29, cnstitute a profiled segment. The profiled segment sections of each profiled segment are rigidly connected to each other. Sections 7, 14 and 26 are connected rigidly together by rotatable shaft 5, and sections 10, 25 and 28 are rigidly connected together by rotatable shaft 6. Sections 3, 16, 27 and 29 are rigidly connected to the foundation by support stand 20. The sections may be considered to be of prismatic shape with a rounded throat for the accommodation of the workpieces.

The cross section of the adjustable channel openings is formed by three laminated profiled segment sections. For example, one adjustable opening is defined by sections 10, 14 and 16 arranged in the form of a diaphragm, with opposite side segments 10 and 14 being pivotable toward and away from one another by shafts 5 and 6 mounted rotatably in channel stands 19. Arranged inside stands 19, at the moving profiled segments 10 and 14, and at intervals along the channel, are hydraulic cylinders 17, 18, 30, 31, 32 and 33, which insure simultaneous pivoting and uniform straightening of a workpiece by all profiled segment sections. During pivoting of the movable segments, the profiled segments are movable substantially radially of the longitudinal axis of the channel cross section and of elongated workpiece 24 located therein. All of the hydraulic cylinders are hinged to a support means secured to the foundation. The cross-sectional size of the channel openings is altered by the pivoting of shafts 5 and 6 by operation of the cylinders to move the movable segments. When the cross section is reduced, the opposing profiled segments move past one another like combs. The profiled segment sections are distributed individually at intervals along the length of the channel. Nowhere along the channel are there any profiled segments exactly opposite each other.

Arranged at the side of the channel is an inlet grid 9 having a stop step 34 against which a stock of workpieces to be straightened may rest. A lifter 11, a profiled-segment section 14, and a link 13 constitute a lifting device in the form of a mechanism having four hinges. The two stationary hinge points are pivot bearing 37 and shaft 5. Pivot bearing 37 is secured to inlet grid 9 which has a rounded inlet slope 12.

Figure 2:
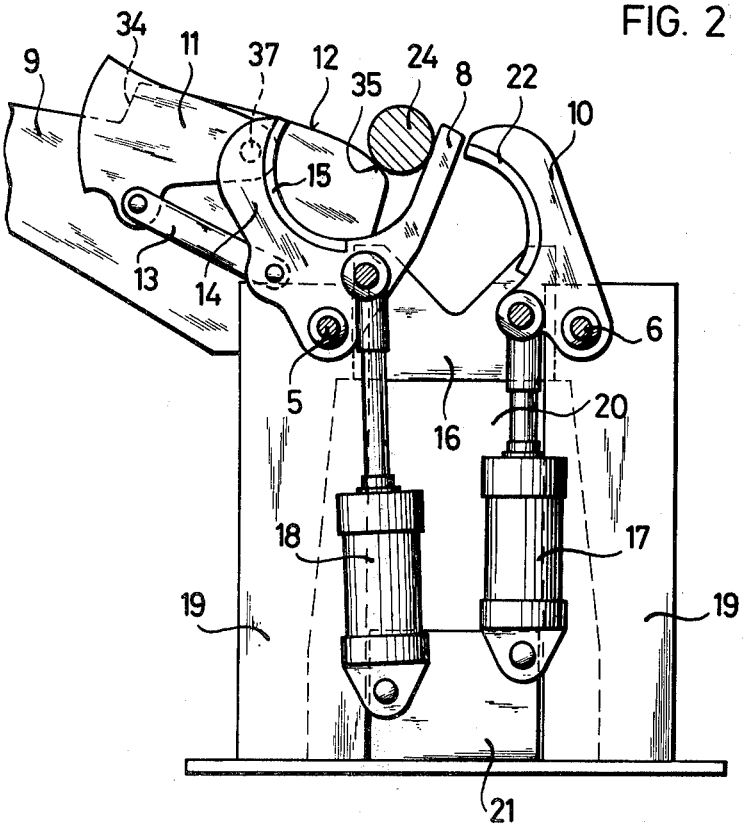
FIG. 2 is a cross-sectional elevational view of the channel accepting a workpiece.

A workpiece which is not shown rests against stop step 34 and is raised by lifter 11 onto inlet slope 12 from which the workpiece rolls slowly toward catcher projection 8. At this time, profiled segment section 14 is pivoted far out as shown in FIG. 2. The said section is then pivoted inwardly so that the workpiece rolls or slides smoothly between rounded edge 35 and projection 8 into immovable bottom profiled segment section 16. When profiled segment section 14 is pivoted to accept the workpiece, the channel opening is circumferentially closed and has the cross section shown in FIG. 4. The cross section of the channel is then automatically reduced, in accordance with characteristics of the workpiece, as shown in FIG. 3, in order to exert a straightening effect on the workpiece. In the alternative, where no straightening is required, the profiled segments are immediately pivoted inwardly to the extent required to feed the workpiece into the straightener.

Pivoting of the profiled segments is controlled by one or more potentiometers. Since the individual profiled segment sections are longitudinally spaced-apart, as seen along the length of the channel in FIG. 1, the workpiece may also be bent beyond its ideal shape. After the pre-straightening operation, the profiled segments are pivoted outwardly away from one another to produce a cross-section which is suitable for feeding the workpiece longitudinally and rotatably, but is as small as possible, bearing in mind the residual curvature of the workpiece and the diameter thereof.

In the arrangement shown and described, there are a plurality of adjustable openings longitudinally spaced along the length of the channel 1 in FIG. 1. Each opening is defined by a plurality of segments 10, 14 and 16; 26, 27 and 28; and 3, 7 and 25. At least one segment for each opening is adjustably movable to expose the openings for lateral introduction of workpieces thereinto, and for varying the size of the openings. In the preferred arrangement, the bottom segments are fixed, and the opposite side segments are movable toward and away from one another. The segments cooperate to form a circumferentially closed opening which completely surrounds the workpiece as it travels longitudinally and rotatably through the channel.

Figure 6:
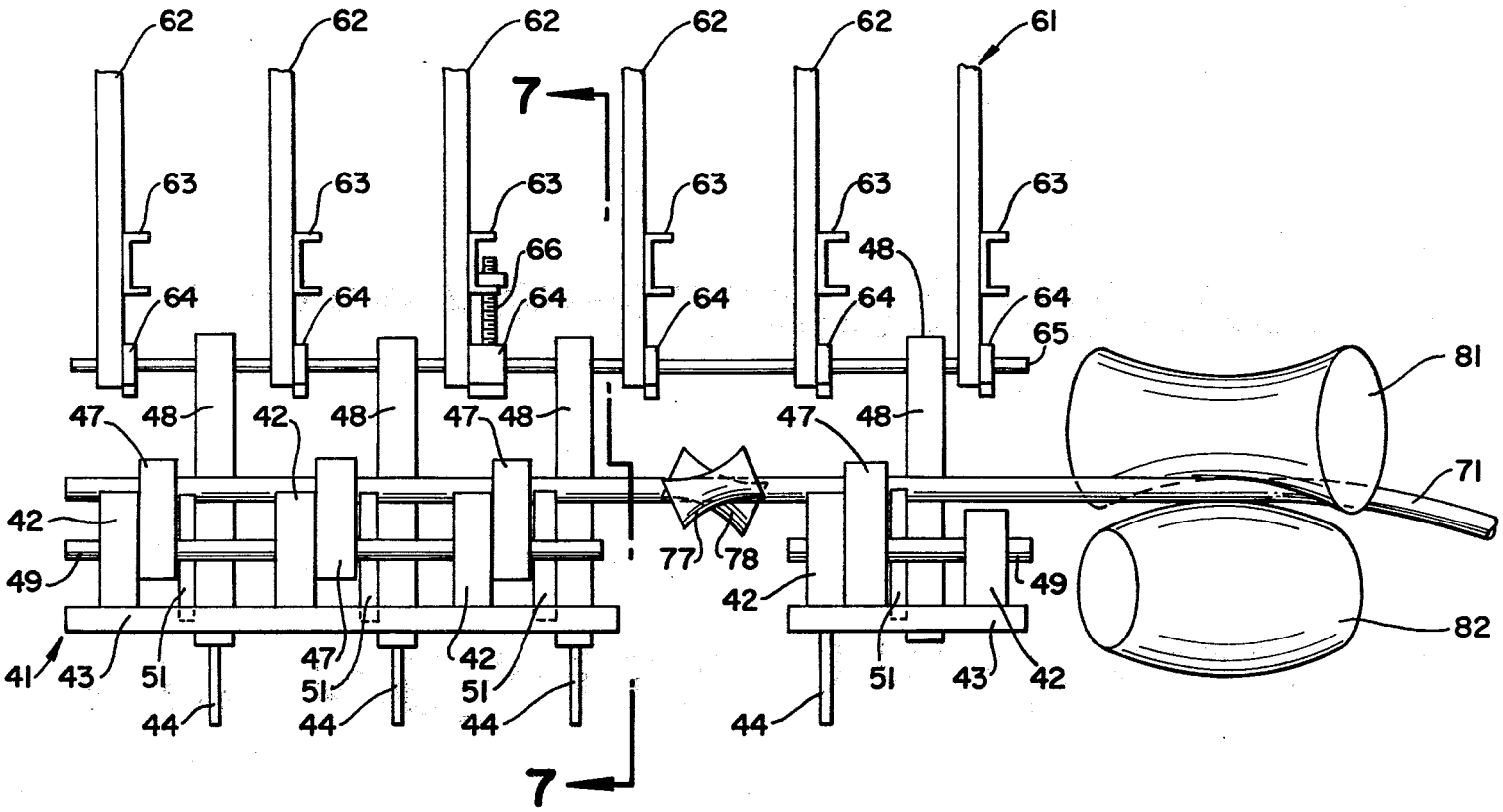
FIG. 6 is a plan view of another embodiment.
Figure 7:
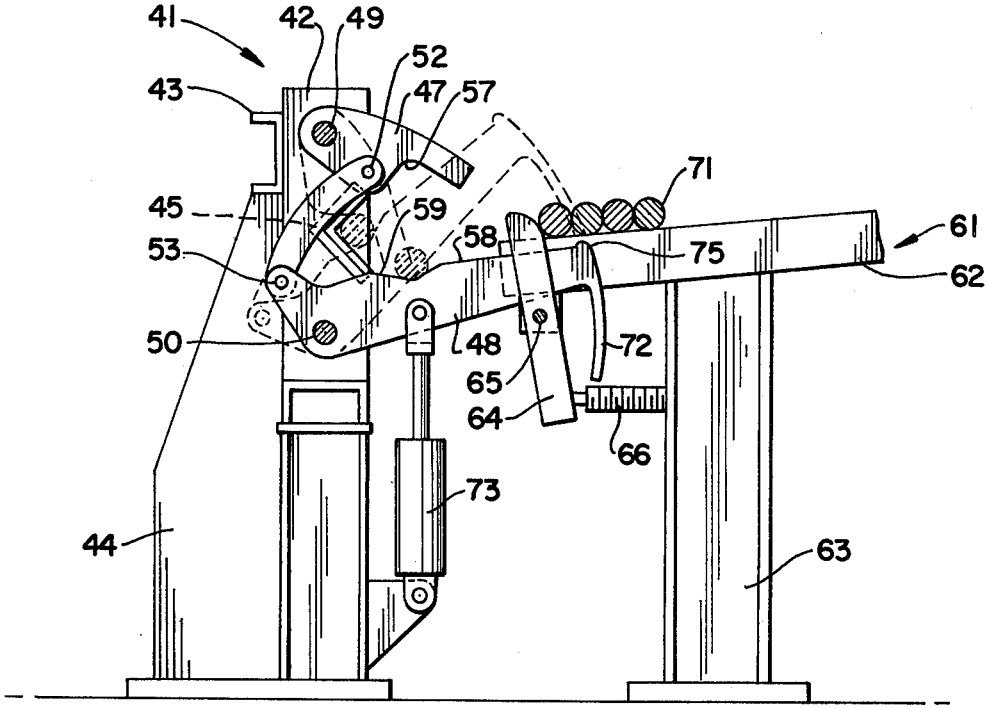
FIG. 7 is a cross-sectional elevational view taken generally on line 7—7 of FIG. 6.

In the embodiment of FIGS. 6 and 7, a supporting frame 41 includes a plurality of spaced upright posts 42 connected by beam 43 and laterally braced by plates 44.

A fixed profiled segment 45 is incorporated in each of the upright posts 42 as best shown in FIG. 7. In the embodiment of FIGS. 6 and 7, the fixed profiled segments 45 correspond generally with the fixed profiled segments 3, 16, 27 and 29 of FIGS. 1–5. Each fixed profiled segment 45 is generally V-shaped in an end view and positioned so the V opens horizontally outwardly.

A plurality of generally opposed movable segments 47 and 48 are respectively secured to shafts 49 and 50 rotatably mounted in the upright posts 42. A connecting link 51 connects movable segments 47 and 48 at pivot connections 52 and 53.

The movable segment 47 is smoothly curved to be generally concave on the periphery of a circle as indicated generally at 57. The movable segment 48 is elongated and includes a generally straight portion 58 which curves inwardly and then outwardly at a generally concave smoothly curved portion 59.

A downwardly inclined workpiece feed table 61 includes a plurality of spaced support members 62 secured to upright supports 63. A plurality of stop levers 64 are secured to a shaft 65 rotatably supported on suitable brackets secured to the feed table 61. At least one adjusting screw 66 is provided for cooperation with one stop lever 64 for rotatably adjusting all of the stop levers 64. A plurality of generally cylindrical workpieces in the form of rods or pipes 71 are supported on the feed table 61 as shown in FIG. 7. The workpieces are usually longitudinally curved, and are to be partially straightened in the feed channel and then fed through straightening rolls.

The movable profiled segment 48 has an arcuate extension 72. The lower movable segments 48 are positioned to fit between the support members 62 as shown in FIG. 6. A fluid cylinder 73 is connected to the supporting frame 41 and to the movable profiled segment 48. The movable segments are movable between an open position providing entrance to the feed channel opening and a closed position completely surrounding a workpiece. Obviously, each group of segments 45, 47 and 48 along the length of the apparatus cooperate to define a plurality of spaced openings which define the feed channel in which workpieces 71 are supported. In the open position of the movable segments, straight upper surface 58 on the movable segment 48 is below the upper surface of the table 61 and the end workpiece 71 is resting against the stop levers 64. Upon operation of the fluid cylinders 73 for moving the movable segments toward one another and toward the fixed segment 45, the end workpiece is lifted and rolls slowly toward the curved portion 59. A relatively small outwardly extending bump 75 may be provided on the outer upper surface of each movable segment 48 for insuring lifting movement of a workpiece. As the movable segments 47 and 48 move from the solid line positions to the dotted line positions, the workpiece is smoothly and positively carried into position against the fixed profiled segment 45 instead of simply being dropped or quickly rolled against the fixed segment. The adjustment screw 66 is capable of varying the position of the stop links 64 to insure that only one workpiece will be lifted by the movable segments 48 when they move toward their closed position.

As in the embodiment of FIGS. 1–5, the movable segments 47 and 48 are moved toward one another and toward the fixed segment 45 to tightly clamp against a workpiece and at least partially straighten same. The movable segments are then moved outwardly slightly away from the workpiece while remaining in surrounding relationship thereto to define a substantially completely closed opening in which the workpiece can be rotated and moved longitudinally. The connecting link 51 is arranged so that it is necessary to provide only one fluid cylinder for moving both of the opposed movable segments. The opposed movable segments will move simultaneously between their closed and open positions. The movable segments 47 and 48 overlap one another in the same manner as shown for movable segments 10 and 14 in FIG. 3.

Carrier means is defined by the upper surface of the lower movable segment 48 and curved portion 59 thereof. Carrier means is also defined by the projection 8 of FIG. 2. The carrier means smoothly and positively carries a workpiece into position against the fixed segments. This contrasts with arrangements wherein the workpieces are allowed to roll or drop into the feed channel. This provides a positive carrier for carrying the workpiece into the feed channel and into its proper position against the fixed segments.

In the embodiment of FIGS. 1–5, the workpiece is lowered against a bottom fixed segment, while in the embodiment of FIGS. 6 and 7, the workpiece is raised and moved laterally by the carrier means for location against the fixed segment. In both embodiments, the defined carrier means is integral with its corresponding movable segment.

The arrangement of FIGS. 6 and 7 has upper and lower movable segments, and a laterally opened fixed segment. The arcuate extension 72 on the lower movable segment 48 rides against the next workpiece during movement of the movable segment to its closed position. The arcuate extension 72 is curved about the axis of the shaft 50 and remains in engagement with the next workpiece during all of the closing movement of the movable segments.

FIG. 6 shows vertically opposed skewed concave feed rolls 77 and 78 through which an elongated workpiece 71 is fed to horizontally opposed straightening rolls 81 and 82. The opposed concave straightening roll 81 and convex roll 82 are horizontally opposed in a horizontal direction which lies in a horizontal plane generally bisecting the fixed segments 45. The fixed segments 45 are positioned and profiled for locating the longitudinal axes of the workpieces in this horizontal plane regardless of the diameter of the workpiece. That is, for a very small diameter workpiece, the longitudinal axis will lie in the same horizontal plane as substantially larger diameter workpieces because the laterally open V-shape of the fixed segments 45 maintain this relationship. The straightening rolls 81 and 82 are horizontally adjustable for accomodating workpieces of different diameter. In addition, different degrees of bending are achieved by inclining the straightening rolls 81 to vary the degree of bend imparted to a workpiece around the convex roll 82. Arranging the apparatus to maintain the longitudinal axes of the workpieces in a common plane automatically provides some compensation for different diameters of workpieces without requiring adjustment of the straightening rolls. For example, smaller diameter workpieces normally require greater degrees of bending for straightening same, and the described arrangement automatically compensates somewhat for this without requiring adjustment.

The feed rolls 77 and 78 are movable apart for positioning a new workpiece in the feed channel. These feed rolls can also be adjustable horizontally and vertically for accommodating varying diameters of workpieces. Once a workpiece is started through the straightening rolls, the feed rolls 77 and 78 can again be moved away from the workpiece.

In the embodiment of FIGS. 1–5, the straightening rolls are positioned in vertically opposed relationship so that the direction in which the rolls are opposed lies in a vertical plane bisecting the fixed segments 3, 16, 27 and 29. The embodiment of FIGS. 1–5 maintains the longitudinal axes of the various diameter workpieces in the same vertical plane.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

Having thus described our invention, we claim:

1. A feed channel for elongated workpieces comprising: a plurality of longitudinally spaced adjustable workpiece receiving openings, each said opening being formed by a fixed segment and at least one movable segment which is movable between open and closed positions for respectively exposing said openings to lateral introduction of workpieces thereinto and closing said openings, opposed straightening rolls which are opposed in a predetermined direction lying in a plane, and said fixed segment being profiled and positioned for supporting workpieces of varying diameters with the longitudinal axes of such workpieces lying substantially in said plane even though such axes are spaced varying distances from the bottom of said fixed segment, and positioned to define a side segment and is generally V-shaped, said plane being generally horizontal and said straightening rolls being horizontally opposed.

2. The feed channel as defined in claim 1 including carrier means for smoothly carrying a workpiece into position against said fixed segment during movement of said movable segment from said open positions to said clamping position.

3. The feed channel as defined in claim 2 wherein said carrier means is integral with said movable segment.

4. The feed channel as defined in claim 1 including a fluid cylinder connected with said movable segment, and a connecting link connected between said movable segment for simultaneous movement thereof by operation of said cylinder.

5. The feed channel as defined in claim 1 wherein said fixed segment is generally V-shaped and is positioned to open laterally, said movable segment comprising upper and lower movable portions.

* * * * *